US007169023B2

(12) United States Patent
Kidowaki et al.

(10) Patent No.: US 7,169,023 B2
(45) Date of Patent: Jan. 30, 2007

(54) METHOD AND APPARATUS FOR MANUFACTURING HOURGLASS WORM ROLLING DIE

(75) Inventors: Koji Kidowaki, Toyohashi (JP); Takayoshi Sasaki, Shizuoka-ken (JP); Toshikatsu Nakashima, Toyokawa (JP)

(73) Assignee: Asmo Co., Ltd., Shizuoka-Ken (JP)

( * ) Notice: Subject to any disclaimer, the term of this patent is extended or adjusted under 35 U.S.C. 154(b) by 87 days.

(21) Appl. No.: 11/146,402

(22) Filed: Jun. 6, 2005

(65) Prior Publication Data

US 2005/0272354 A1 Dec. 8, 2005

(30) Foreign Application Priority Data

Jun. 8, 2004 (JP) ..... 2004-170147

(51) Int. Cl.

| | |
|---|---|
| ***B24B 1/00*** | (2006.01) |
| ***B24B 7/30*** | (2006.01) |
| *B24B 3/00* | (2006.01) |
| *B24B 5/00* | (2006.01) |
| *B23F 5/20* | (2006.01) |

(52) U.S. Cl. ..... 451/47; 451/219; 451/147; 409/51

(58) Field of Classification Search ..... 451/47, 451/147, 161, 219, 279; 51/287; 409/51, 409/26

See application file for complete search history.

(56) References Cited

U.S. PATENT DOCUMENTS

| | | | | |
|---|---|---|---|---|
| 4,815,239 | A * | 3/1989 | Sommer | 451/5 |
| 4,989,316 | A * | 2/1991 | Logan et al. | 29/527.3 |
| 4,998,385 | A * | 3/1991 | Umezono et al. | 451/47 |
| 5,325,634 | A * | 7/1994 | Kobayashi et al. | 451/253 |
| 6,575,812 | B2 * | 6/2003 | Wirz | 451/9 |
| 6,905,292 | B2 * | 6/2005 | Schuon | 409/2 |
| 6,951,501 | B2 * | 10/2005 | Tan | 451/5 |
| 7,004,826 | B2 * | 2/2006 | Linnenbrink | 451/194 |
| 7,044,691 | B2 * | 5/2006 | Zhang et al. | 409/48 |
| 2002/0119737 | A1 * | 8/2002 | Tan | 451/47 |

FOREIGN PATENT DOCUMENTS

| | | |
|---|---|---|
| JP | 2003-320434 | 11/2003 |

* cited by examiner

*Primary Examiner*—Lee D. Wilson
*Assistant Examiner*—Alvin J. Grant
(74) *Attorney, Agent, or Firm*—MacMillan, Sobanski & Todd, LLC

(57) ABSTRACT

An apparatus manufactures a die for rolling an hourglass worm in improved processing accuracy. The apparatus includes a swing table swung, a movement table mounted on the swing table, and a workpiece shaft arranged on the movement table. The axis of a disk-shaped workpiece is perpendicular to a swing axis of the swing table. The workpiece includes a peripheral surface with a cross-section extending along the workpiece axis and defining an arc substantially identical to the arc of the root surface of the hourglass worm. The movement table is arranged so that the swing axis of the swing table extends through a center of curvature of the arc defined on the peripheral surface of the workpiece. A synchronization mechanism swings the swing table in synchronism with the rotation of the workpiece shaft.

18 Claims, 12 Drawing Sheets

METHOD AND APPARATUS FOR MANUFACTURING HOURGLASS WORM ROLLING DIE

CROSS REFERENCE TO RELATED APPLICATIONS

This application claims the benefit of Japanese Patent Application No. 2004-170 147, filed Jun. 8, 2004, the disclosure of which is incorporated herein by reference.

BACKGROUND OF THE INVENTION

The present invention relates to a method and an apparatus for manufacturing a rolling die when manufacturing an hourglass worm.

A reduction gear mechanism using an hourglass worm is known in the art. The hourglass worm has more teeth that mate with a cylindrical worm than a worm wheel, and is thus used for vehicles, for example, in small-size motors, which incorporate reduction gear mechanisms, and high-load reduction gears.

Generally, an hourglass worm is manufactured through a cutting process performed by a screw cutting machine or a gear hobbing machine and the like, or a grinding process using a grindstone. However, in such processing methods, the processing time is long, and is difficult to produce the hourglass worm in large quantities. A rolling process using a die is thus performed to produce the hourglass worm in large quantities. Japanese Laid-Open Patent Publication No. 2003-320434 describes a method for manufacturing a die used in rolling.

The above publication describes a method for manufacturing a circular die. The circular die is manufactured by forming teeth grooves to roll an hourglass worm on the peripheral surface of a disk-shaped workpiece using a rotary tool (rotary grindstone). The workpiece is formed so that when viewing a cross-section of the workpiece that includes the workpiece axis, the peripheral surface is arcuate and projects radially outward with a radius of curvature equal to that of the round surface at the teeth roots of an hourglass worm.

The rotary tool is attached to an oscillating unit supported by two oscillating arms. More specifically, two holders projecting towards the workpiece are arranged in the oscillating unit. The rotary tool is rotatably supported by the holders. A drive motor for rotating the rotary tool is mounted on one of the holders. An auxiliary motor for inclining the rotary tool is mounted on the oscillating unit at the surface opposite the workpiece so that the axis of the rotary tool inclines with respect to the axis of the workpiece by the lead angle of the hourglass worm.

When forming the teeth grooves for rolling an hourglass worm on the peripheral surface of a workpiece, the rotary tool and the workpiece are rotated with the axis of the rotary tool inclined relative to the axis of the workpiece by an amount equivalent to the lead angle of the hourglass worm. Simultaneously, the oscillating arms oscillate the oscillating unit about the center of curvature of the arc on the peripheral surface of the workpiece in synchronization with the rotation of the workpiece. This oscillates the rotary tool about the center of curvature of the arc. Further, the rotary tool is fed towards the workpiece by extending or retracting the oscillating arms or the holders. Therefore, the teeth grooves for rolling an hourglass worm is formed on the peripheral surface of the workpiece by oscillating the rotary tool in a reciprocating manner within the thickness range of the workpiece, while rotating the workpiece in forward and reverse directions in a state in which the inclination of the rotary tool is kept constant.

However, in the circular die manufacturing method described in the above publication, the rotary tool is rotated and oscillated by the oscillating unit in addition to being fed towards the workpiece to form the teeth grooves on the die. Thus, error caused by rotation of the rotary tool, error caused by oscillation of the tool, and processing error caused by feeding the tool are cumulative. This may increase the pitch error of the teeth grooves formed on the peripheral surface of the workpiece. The hourglass worm of a small-size motor requires high accuracy. Thus, it is desirable that the hourglass worm be manufactured with a circular die that is highly accurate.

SUMMARY OF THE INVENTION

It is an object of the present invention to provide a method and an apparatus for manufacturing an hourglass worm rolling die that improves the processing accuracy.

One aspect of the present invention is a method for manufacturing a die for rolling an hourglass worm. The hourglass worm includes a curved root surface with a cross-section extending along an axis of the hourglass worm that defines an arc. The method includes the steps of rotating a disk-shaped workpiece about an axis of the workpiece, the workpiece including a peripheral surface with a cross-section extending along the axis of the workpiece that defines an arc corresponding to the arc of the root surface of the hourglass worm, rotating a rotary grindstone about an axis of the rotary grindstone, inclining the axis of the rotary grindstone relative to the axis of the workpiece by a lead angle of the hourglass worm, moving the workpiece relative to the rotary grindstone so that the workpiece, when viewed from the rotary grindstone, swings about a reference axis substantially perpendicular to the axis of the workpiece and extends substantially through a center of curvature of the arc defined on the peripheral surface of the workpiece, and forming teeth grooves, for rolling the hourglass worm, on the peripheral surface of the workpiece by rotating and pressing the rotary grindstone against the peripheral surface of the workpiece while moving the workpiece with respect to the rotary grindstone in synchronism with the rotation of the workpiece.

A further aspect of the present invention is an apparatus for manufacturing a die for rolling an hourglass worm. The hourglass worm includes a curved root surface with a cross-section extending along an axis of the hourglass worm that defines an arc. The apparatus includes a swing table swingable about a swing axis. A movement table is movably mounted on the swing table. A workpiece shaft is arranged on the movement table. The workpiece shaft rotates a disk-shaped workpiece about an axis of the workpiece. The axis of the workpiece is substantially perpendicular to a swing axis of the swing table. The workpiece includes a peripheral surface with a cross-section extending along the axis of the workpiece that defines an arc substantially identical to the arc of the root surface of the hourglass worm. The movement table is arranged so that the swing axis of the swing table extends substantially through a center of curvature of the arc defined on the peripheral surface of the workpiece. A rotary grindstone forms teeth grooves, for rolling the hourglass worm, on the peripheral surface of the workpiece. An axis of the rotary grindstone is inclined relative to the axis of the workpiece by a lead angle of the hourglass worm. The rotary grindstone is movable towards or away from the center of curvature of the arc defined on the peripheral surface of the workpiece. A synchronization mechanism swings the swing table in synchronism with the rotation of the workpiece shaft.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3(*b*) is a cross-sectional view showing the hourglass worm of FIG. 3(*a*);

FIG. 4(*b*) is a side view showing the die of FIG. 4(*a*);

FIG. 8(*b*) is a schematic diagram showing a state in which the axis of the rotary grindstone is inclined with respect to the axis of the workpiece by the lead angle of the hourglass worm;

FIG. 9(*b*) is a plan view of FIG. 9(*a*);

FIG. 16(*b*) is a graph showing the relationship between the rotation amount $\theta$ of the workpiece and the feed amount $(x(\theta))+\Delta x(\theta))$ of the rotary grindstone; and FIG. 16(*c*) is a graph showing the relationship between the rotation amount $\theta$ of the workpiece and the slide amount $\Delta z(\theta)$ of the workpiece.

DETAILED DESCRIPTION OF THE PREFERRED EMBODIMENTS

Figure 1:
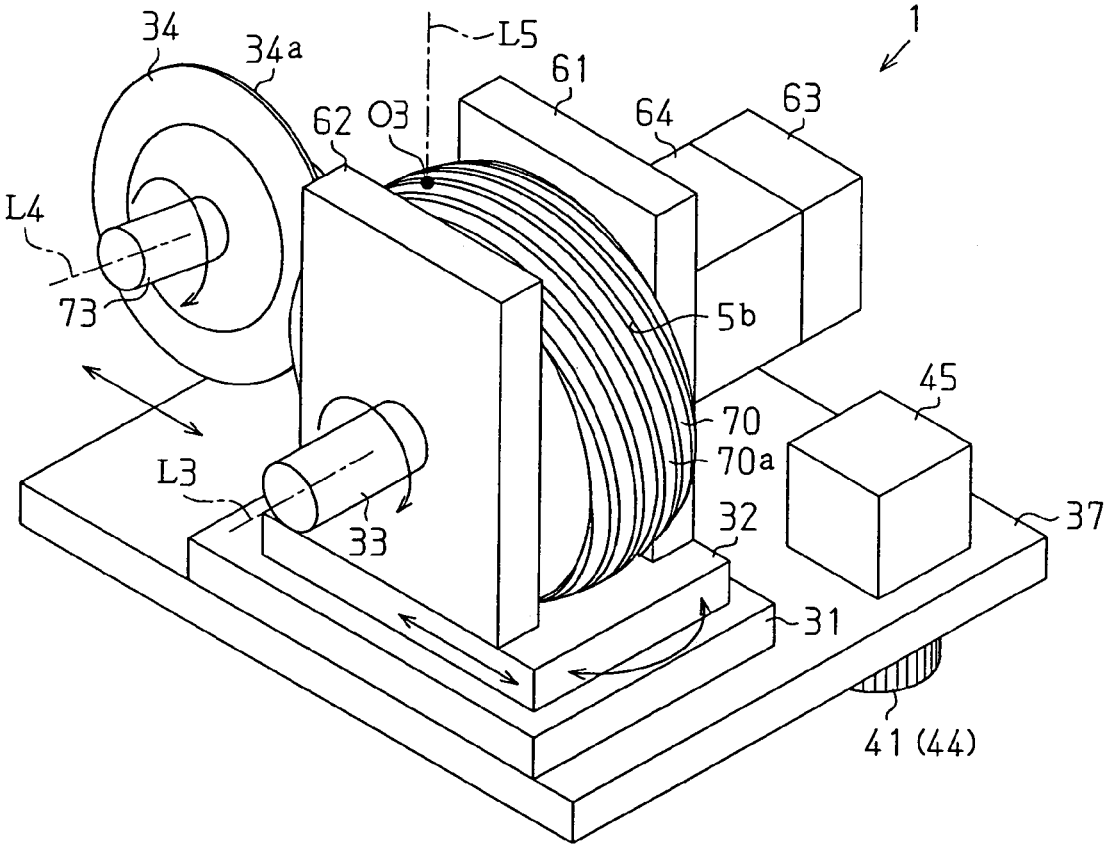
FIG. 1 is a schematic view of an apparatus for manufacturing an hourglass worm rolling die according to a first embodiment of the present invention.
Figure 2:
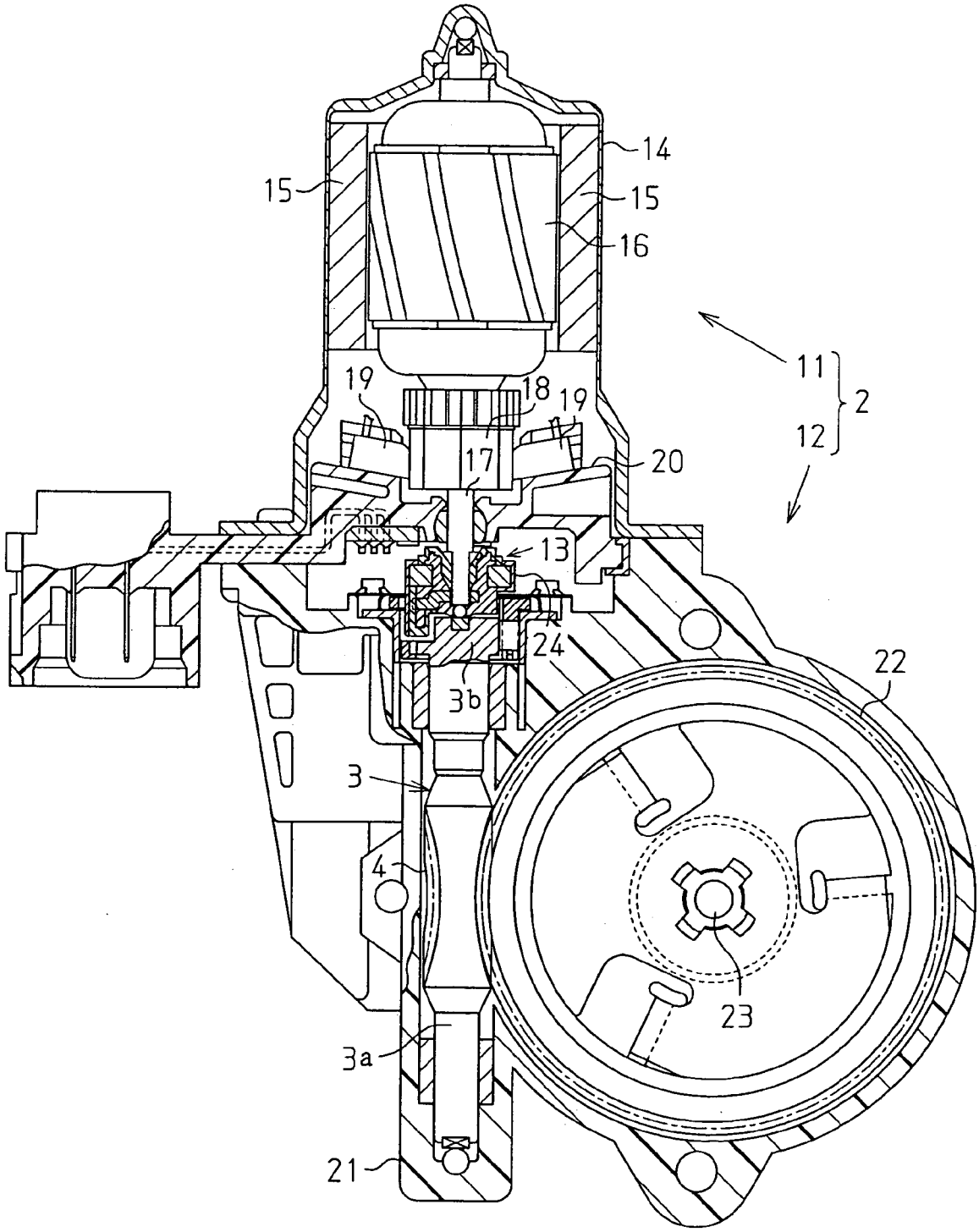
FIG. 2 is a cross-sectional view of a motor incorporating a reduction gear mechanism including an hourglass worm roll formed by the die manufactured with the apparatus of FIG. 1.

A first embodiment of the present invention will now be described with reference to the drawings. FIG. 1 shows an apparatus 1 for manufacturing an hourglass worm rolling die 5. The manufacturing apparatus 1 manufactures an hourglass worm rolling die 5, which is used to form an hourglass worm 4 on a worm shaft 3 arranged in a motor 2 that incorporates a reduction gear mechanism, as shown in FIG. 2.

The motor 2 will be now described. As shown in FIG. 2, the motor 2 includes a motor portion 11, a reduction gear portion 12, and a clutch 13. The motor 2 includes a cylindrical yoke 14, which has opposing planar surfaces and a closed end, and magnets 15, which are fixed to the inner surface of the yoke 14. An armature 16 is rotatably accommodated in the magnet 15. The armature 16 includes a rotary shaft 17. A commutator 18 is fixed to the rotary shaft 17 at the open end of the yoke 14. A brush holder 20 including a brush 19 that contacts the commutator 18 is fitted in the opening of the yoke 14.

When drive current from an external device is supplied to the motor portion 11, the drive current flows via the brush 19 and the commutator 18 to a wire wound around the armature 16. The armature 16 (rotary shaft 17) is then rotated, that is, the motor portion 11 is rotatably driven based on the supply of the drive current.

Figure 3A:
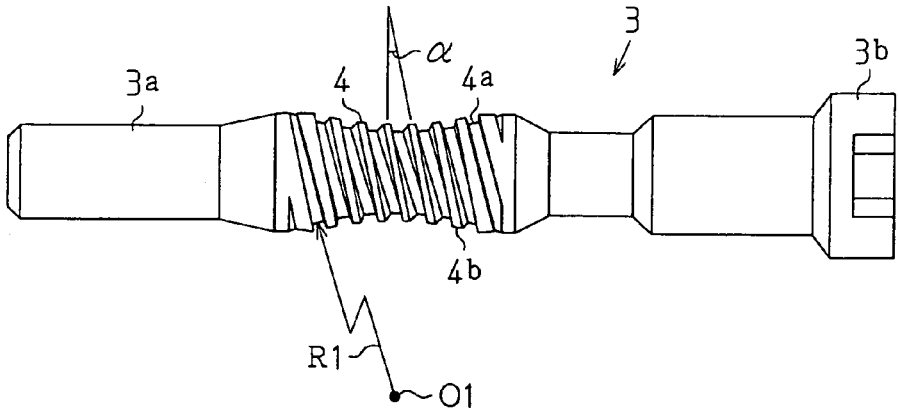
FIG. 3(*a*) is a front view showing the worm shaft of FIG. 2.
Figure 3B:
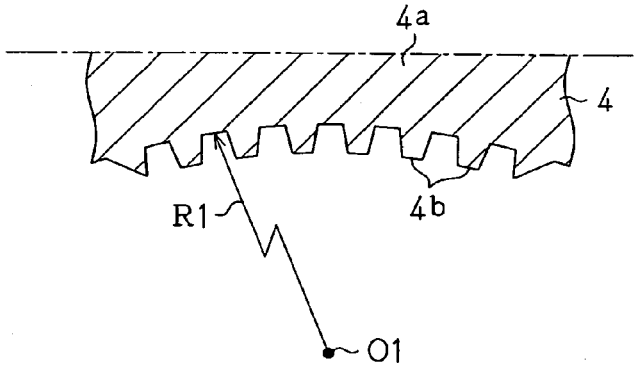

The reduction gear portion 12 includes a gear housing 21, a worm shaft 3, a worm wheel 22, and an output shaft 23. The worm shaft 3 and the worm wheel 22 are accommodated in the gear housing 21. As shown in FIG. 3(*a*), the worm shaft 3 has a worm shaft main body 3*a* and a driven side rotating body 3*b*, which is integrally formed at the side of the worm shaft main body 3*a* that is closer to the motor portion 11 (refer to FIG. 2). The hourglass worm 4 is formed at an axially central portion of the worm shaft main body 3*a*. The hourglass worm 4 includes an hourglass core 4*a*, of which outer diameter decreases towards the central portion. Teeth 4*b* extending at lead angle $\alpha$ is integrally formed with the core 4*a* on the peripheral surface of the core 4*a*. As shown in FIG. 3(*b*), the peripheral surface of the core 4*a*, which defines the roots of the teeth 4*b*, is arcuate, has a curvature radius R1, and extends about a center of curvature O1. That is, the root surface of the hourglass worm 4 has an arc of curvature radius R1 when viewing a cross-section that includes the axis of the hourglass worm 4.

As shown in FIG. 2, the worm wheel 22 is accommodated in the gear housing 21 and mated with the hourglass worm 4. The output shaft 23, which rotates integrally and coaxially with the worm wheel 22, is coupled to the central part of the worm wheel 22. The output shaft 23 is connected to a window regulator (not shown) for opening and closing the window glass of a vehicle and the like.

The motor portion 11 and the reduction gear portion 12 are coupled to each other by attaching the yoke 14 to the gear housing 21. Further, the rotary shaft 17 of the armature 16 is connected to the worm shaft 3 by the clutch 13. The clutch 13 includes a driving side rotating body 24, which is attached to the distal end of the rotary shaft 17, located on the side closer to the reduction gear portion 12, and the driven side rotating body 3*b*. The clutch 13 transmits the rotation of the driving side rotating body 24, driven by the motor portion 11, to the driven side rotating body 3*b* and rotates the worm shaft 3. The speed of the rotation is reduced by the hourglass worm 4 and the worm wheel 22. Then, the rotation is output from the output shaft 23 to the window regulator. If a load that rotates the output shaft 23 is applied from the window regulator when the motor 2 is stopped, the clutch 13 functions to lock the driven side rotating body 3*b* and restrict the rotation of the output shaft 23.

Figure 4A:
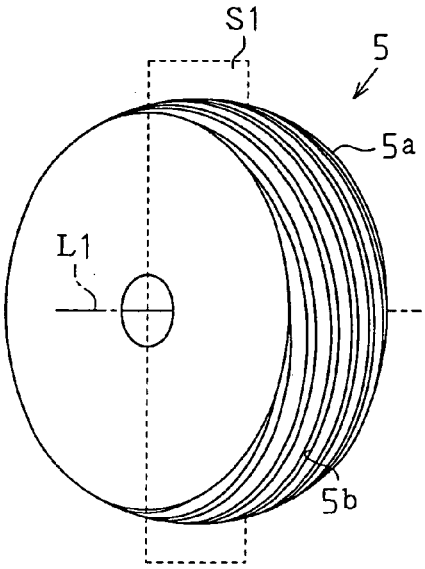
FIG. 4(*a*) is a perspective view showing the die manufactured with the apparatus of FIG. 1.
Figure 4B:
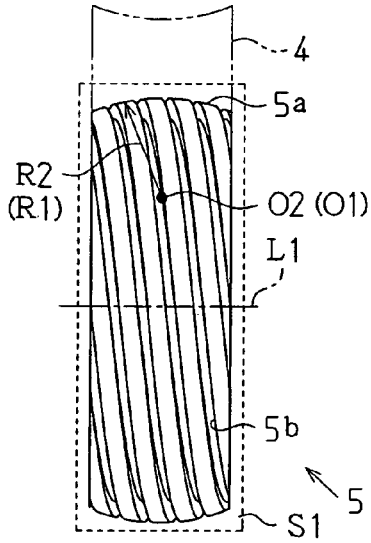

The rolling die 5 will now be described. As shown in FIG. 4(*a*), the rolling die is disk-shaped. The thickness of the rolling die 5 in the axial direction is equal to the axial length of the hourglass worm 4. As shown in FIG. 4(*b*), the peripheral surface 5*a* of the rolling die 5 is arcuate and has curvature radius R2, which is equal to the curvature radius R1 of the root surface of the teeth 4*b* of the hourglass worm 4, when viewed along a plane S1 that extends radially through the axis L1 of the rolling die 5. A plurality of teeth grooves 5*b* shaped in correspondence with the teeth 4*b* of the hourglass worm 4 are formed in the peripheral surface Sa. The teeth grooves 5*b* are arranged in the axial direction (the direction of the axis L1) of the rolling die 5 with a pitch corresponding to the pitch of the hourglass worm 4. When the hourglass worm 4 contacts the peripheral surface 5*a* of the rolling die 5, the center of curvature O1 of the root surface of the teeth 4*b* on the hourglass worm 4 coincide with the center of curvature O2 of the peripheral surface 5*a* of the rolling die 5.

The structure of the manufacturing apparatus 1 will now be described. As shown in FIG. 1, the manufacturing apparatus 1 includes a swing table 31, a slide table 32, which functions as a movement table, a workpiece shaft 33, and a rotary grindstone 34. The manufacturing apparatus 1 is mounted on a table 37 of a multi-purpose screw grinding machine 36 (refer to FIG. 5 and FIG. 7).

Figure 5:
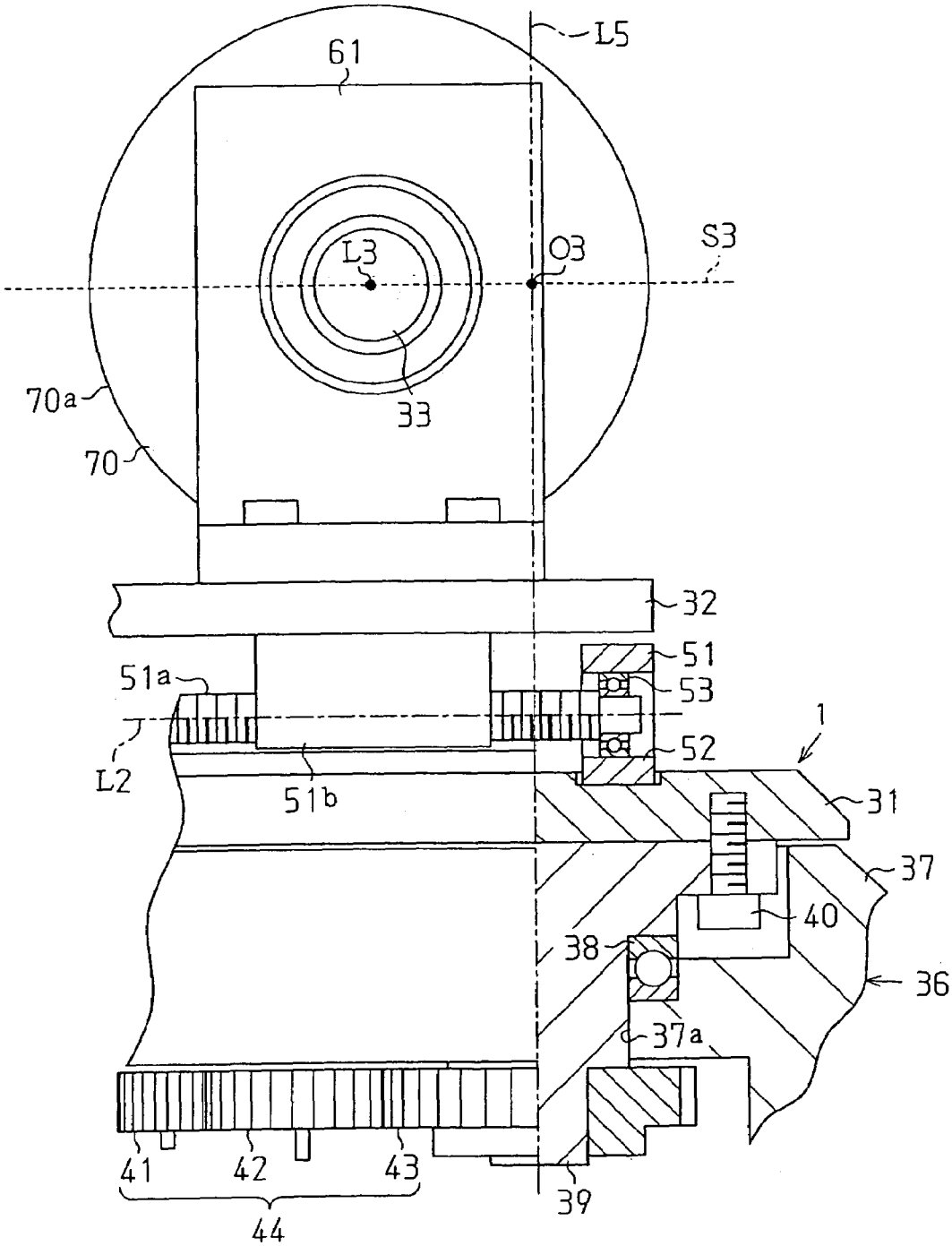
FIG. 5 is a cross-sectional view of the manufacturing apparatus of FIG. 1.

As shown in FIG. 5, the swing table 31, which functions as a turn table, is mounted in a swingable (oscillatable) manner on the table 37 of the multi-purpose screw grinding machine 36. More specifically, an opening 37*a* extends through the table 37. A bearing 38 is fitted in the opening 37*a*. A swing shaft 39 rotatably supported by the bearing 38 is inserted through the opening 37*a*. The swing table 31 is fixed to the upper end of the swing shaft 39 by a screw 40. A reduction gear train 44 formed by mating a plurality of gears 41 to 43 is arranged on the lower side of the table 37. The first gear 41 of the reduction gear train 44 is connected to a swing shaft drive motor 45 (refer to FIGS. 1 and 6), and the third gear 43 is coupled to the lower end of the swing shaft 39 so that the third gear 43 and the swing shaft 39 rotate integrally with each other. Therefore, when the swing shaft drive motor 45 is driven to generate rotation, the reduction gear train 44 reduces the speed of the rotation and transmits the rotation to the swing shaft 39. The rotation swings the swing shaft 39 integrally with the swing table 31.

The slide table 32 is mounted on the upper surface of the swing table 31 with a slide mechanism 51 arranged in between. The slide mechanism 51 is formed by a ball screw, which includes a screw shaft 51*a* and a nut 51*b*, which is movably connected to the screw shaft 51*a*. The screw shaft 51*a* extends parallel to the swing table 31 above the swing table 31. A holding member 52 is attached to the swing table 31, and a bearing 53 is fitted in the holding member 52. One end of the screw shaft 51*a* is rotatably supported by the bearing 53, and the other end is connected to a slide table drive motor 54 (refer to FIG. 6).

The slide table 32 is attached on the upper part of the nut 51*b* so as to be parallel to the swing table 31 and moves integrally with the nut 51*b*. Therefore, when the slide table drive motor 54 is driven, the screw shaft 51*a* is rotated in accordance with the driven direction. When the screw shaft 51*a* is rotated, the rotation slides (moves) the nut 51*b* in a direction corresponding to the rotation direction and along the axial direction of the screw shaft 51*a*. When the nut 51*b* slides, the slide table 32 moves integrally with the nut 51*b*.

A pair of support members 61 and 62 (refer to FIG. 1) are attached to the upper surface of the slide table 32. The workpiece shaft 33 is supported by the support members 61 and 62. The support members 61 and 62 face toward each other and are spaced apart by a predetermined distance on the slide table 32. The workpiece shaft 33 is rotatably supported at two locations by the support members 61 and 62. Further, the workpiece shaft 33 extends parallel to the slide table 32 and orthogonal to the axis L2 of the screw shaft 51*a*. The workpiece shaft drive motor 63 is connected to one end of the workpiece shaft 33 by a reduction gear 64 (refer to FIGS. 1 and 6). The workpiece 70 (refer to FIG. 1), which is formed into the rolling die 5, is attached to the workpiece shaft 33 between the support members 61 and 62. When the workpiece shaft drive motor 63 is driven to generate rotation, the speed of the rotation is reduced by the reduction gear 64. The rotation is then transmitted to the workpiece shaft 33. This rotates the workpiece 70 with the workpiece shaft 33.

As shown in FIG. 1, the rotary grindstone 34 is disk-shaped and has a grinding portion 34*a*, of which the outer periphery is shaped in correspondence the teeth 4*b* of the hourglass worm 4. The rotary grindstone 34 is attached to and rotated integrally with a grindstone shaft 73. The grindstone shaft 73 is rotatably supported by a grindstone base 72 (refer to FIG. 6). A grindstone drive motor 74 (refer to FIG. 6) is connected to the grindstone shaft 73 to drive and integrally rotate the grindstone shaft 73 and the rotary grindstone 34. Further, a grindstone inclination motor 75 is connected to the grindstone shaft 73 (refer to FIG. 6). The grindstone inclination motor 75 inclines the rotary grindstone 34 so that the axis L4 of the rotary grindstone 34 inclines relative to the axis L3 of the workpiece 70 by the lead angle $\alpha$ of the hourglass worm 4 (refer to FIG. 8(*b*)).

The grindstone base 72 is arranged so that the rotary grindstone 34, which is attached to the grindstone shaft 73, contacts the peripheral surface 70*a* of the workpiece 70 from the radial outward side of the workpiece 70. When the grindstone base drive motor 76 (refer to FIG. 6) is driven, the grindstone base 72 moves in the radial direction of the workpiece 70. This moves the rotary grindstone 34 towards the workpiece 70 in the radial direction of the workpiece 70.

Figure 6:
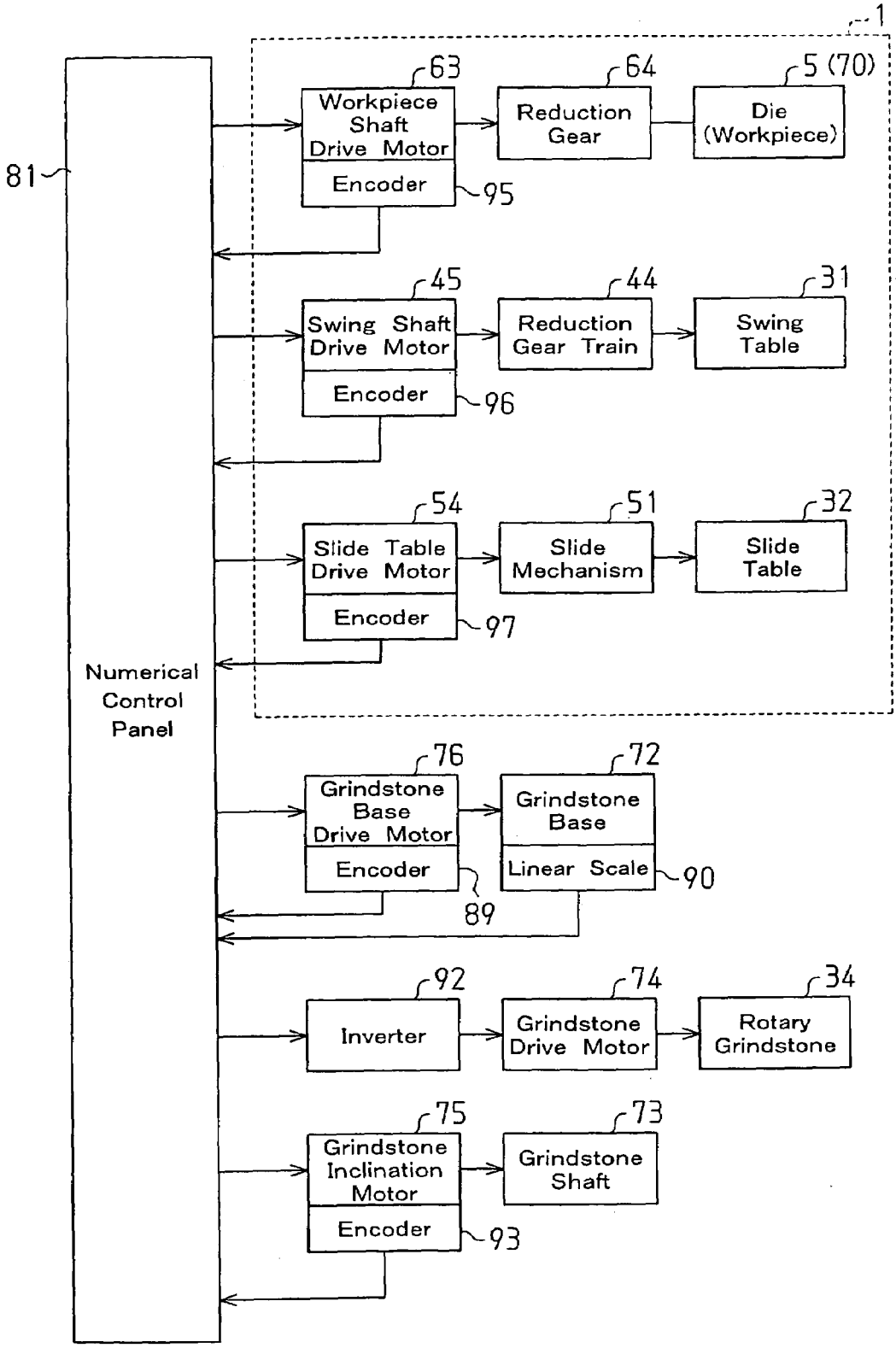
FIG. 6 is a block diagram showing the manufacturing apparatus of FIG. 1 incorporated in a multi-purpose screw grinding machine.

FIG. 6 is a block diagram of the manufacturing apparatus 1 when it is applied to the multi-purpose screw grinding machine 36. The structure of the multi-purpose screw grinding machine 36 will now be described.

Figure 7:
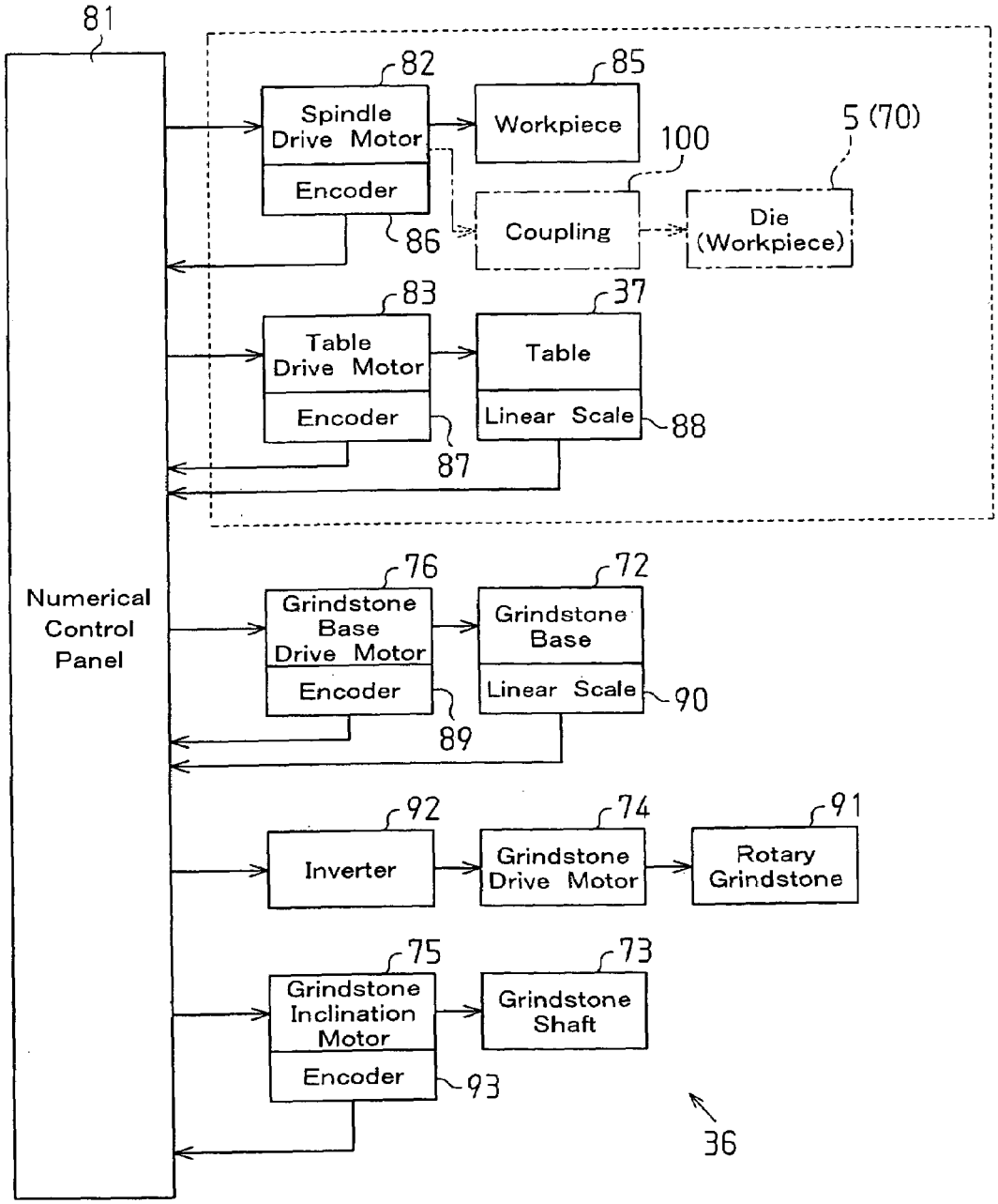
FIG. 7 is a block diagram showing the multi-purpose screw grinding machine of FIG. 6.

As shown in FIG. 7, the multi-purpose screw grinding machine 36 includes a numerical control panel 81, which functions as a synchronization mechanism. A spindle drive motor 82, a table drive motor 83, the grindstone drive motor 74, the grindstone inclination motor 75, and the grindstone base drive motor 76 are connected to the numerical control panel 81.

A spindle for rotating a workpiece 85 is connected to the spindle drive motor 82. The spindle drive motor 82 generates rotation in accordance with a signal output from the numerical control panel 81. This rotates the spindle, or the workpiece 85. Further, an encoder 86 is included in the spindle drive motor 82. The encoder 86 sends a signal corresponding to the rotation state of the spindle drive motor 82 to the numerical control panel 81. Based on the signal, the numerical control panel 81 determines the rotation state of the spindle drive motor 82, that is, the number of rotations, the rotation speed, and the rotation position, and accordingly controls the spindle drive motor 82.

The table 37, to which the workpiece 85 is attached, is connected to the table drive motor 83. The table drive motor 83 generates rotation in accordance with a signal output from the numerical control panel 81 to move the table 37. An encoder 87 is included in the table drive motor 83 to send a signal, which corresponds to the rotation state of the table drive motor 83, to the numerical control panel 81. Based on the signal, the numerical control panel 81 determines the rotation state of the table drive motor 83, that is, the number of rotations, the rotation speed, and the rotation position, and accordingly controls the table drive motor 83. A linear scale 88 is included in the table 37 to send a signal, which corresponds to the position of the table 37, to the numerical control panel 81. The numerical control panel 81 determines the position of the table 37 based on the signal.

The grindstone base 72 is connected to the grindstone base drive motor 76. The grindstone base drive motor 76 generates rotation in accordance with a signal output from the numerical control panel 81 to move the grindstone base 72. This feeds a rotary grindstone 91 towards the workpiece 85. An encoder 89 is included in the grindstone base drive motor 76 to send a signal, which corresponds to the rotation state of the grindstone base drive motor 76, to the numerical control panel 81. The numerical control panel 81 determines the rotation state of the grindstone base drive motor 76, such as, the number of rotations, the rotation speed, and the rotation position, and accordingly controls the grindstone base drive motor 76. A linear scale 90 is included in the grindstone base 72 to send a signal, which corresponds to the position of the grindstone base 72, to the numerical control panel 81. The numerical control panel 81 determines the position of the grindstone base 72 based on the signal and controls the amount the rotary grindstone 91 is fed towards the workpiece 85.

The grindstone drive motor 74 is connected to the numerical control panel 81 by an inverter 92. The rotary grindstone 91 is connected to the grindstone drive motor 74 by the grindstone shaft 73. The inverter rotates the grindstone drive motor 74 in accordance with the signal output from the numerical control panel 81 to rotate the grindstone shaft 73, or the rotary grindstone 91.

The grindstone shaft 73 is connected to the grindstone inclination motor 75. The grindstone inclination motor 75 generates rotation in accordance with a signal output from the numerical control panel 81 to swing the rotary grindstone 91 by the lead angle of the worm that is to be processed on the workpiece 85. An encoder 93 is included in the grindstone inclination motor 75 to send a signal corresponding to the rotation state of the grindstone inclination motor 75 to the numerical control panel 81. Based on the signal, the numerical control panel 81 determines the rotation, that is, the number of rotations, the rotation speed, and the rotation position of the grindstone inclination motor 75, and accordingly controls the grindstone inclination motor 75.

In the multi-purpose screw grinding machine 36 of the present embodiment, the workpiece shaft drive motor 63 is connected to the numerical control panel 81 in place of the spindle drive motor 82, as shown in FIG. 6. The swing shaft drive motor 45 and the slide table drive motor 54 are further connected to the numerical control panel 81. The workpiece shaft drive motor 63, the swing shaft drive motor 45, and the slide table drive motor 54 are connected to a vacant control axis in the numerical control panel 81. Therefore, in the multi-purpose screw grinding machine 36 of the present embodiment, the section surrounded by the broken line shown in FIG. 7 is replaced by the section (manufacturing apparatus 1) surrounded by the broken line shown in FIG. 6. The encoders 95, 96, and 97 are respectively included in the workpiece shaft drive motor 63, the swing shaft drive motor 45, and the slide table drive motor 54. Encoders 95, 96, and 97 respectively send signals corresponding to the rotation state of the drive motors 63, 45, and 54 to the numerical control panel 81. Based on the signals, the numerical control panel 81 determines the rotation state of the drive motors 63, 45, and 54 and accordingly controls the drive motors 63, 45, and 54.

The method for manufacturing the rolling die 5 for rolling the hourglass worm 4 with the multi-purpose screw grinding machine 36 incorporating the above manufacturing apparatus 1 will now be described.

Figure 8A:
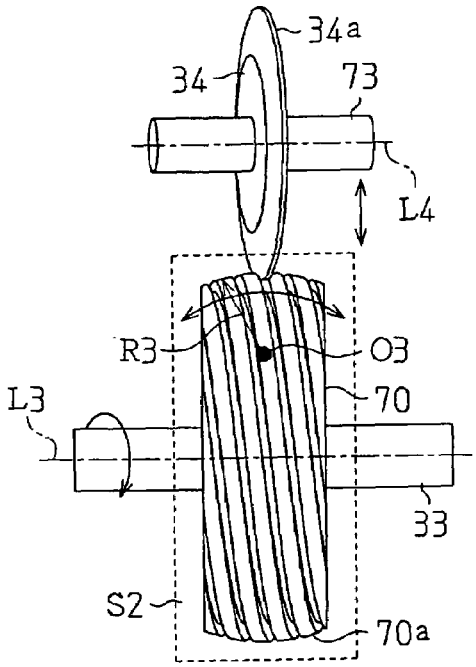
FIG. 8(*a*) is a plan view showing a rotary grindstone contacting a workpiece.
Figure 8B:
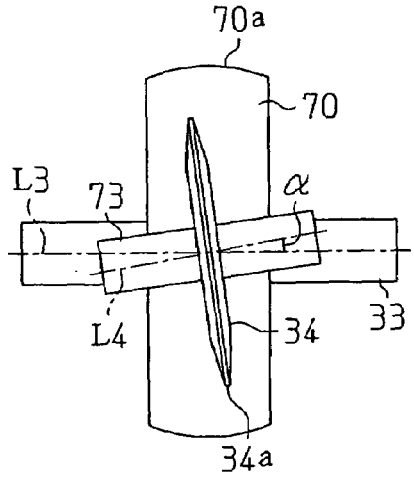

First, the workpiece 70 that is formed into the rolling die 5 will be described. As shown in FIGS. 8(*a*) and 8(*b*), the workpiece 70 is disk-shaped. The thickness of the workpiece 70 in the axial direction is equal to the axial length of the hourglass worm 4. The peripheral surface 70*a* of the workpiece 70 is arcuate and has a curvature radius R3 equal to the curvature radius R1 of the root surface at the teeth 4*b* of the hourglass worm 4 when viewed along a plane S2 that extends radially along the axis L3 of the workpiece 70. In other words, the peripheral surface 70*a* of the workpiece 70 is arcuate and identical to the arcuate root surface of the teeth 4*b* in the hourglass worm 4 as viewed on a cross-section including the axis L3 of the workpiece 70. That is, the peripheral surface 70*a* of the workpiece 70 of the present embodiment is arcuate and projects outwardly at a curvature equal to the curvature of the peripheral surface 5*a* of the rolling die 5, which is formed by processing the workpiece 70.

A method for manufacturing the rolling die 5 will now be described. As shown in FIG. 1, the workpiece 70 is attached to the workpiece shaft 33. When the numerical control panel 81 drives the slide table drive motor 54 to slide the slide table 32, the swing axis L5 of the swing shaft 39 coincides with the center of curvature O3 of the peripheral surface 70*a* of the workpiece 70 when viewing a plane S3 that extends through the axis L3 of the workpiece 70 and parallel to the swing table 31, as shown in FIG. 5. As shown in FIGS. 8(*a*) and 8(*b*), the numerical control panel 81 drives the grindstone inclination motor 75 to incline the grindstone shaft 73 with respect to the axis L3 of the workpiece 70 so that the axis L4 of the rotary grindstone 34 is inclined by the lead angle $\alpha$ of the hourglass worm 4.

Subsequently, the numerical control panel 81 drives the workpiece shaft drive motor 63 and the grindstone drive motor 74 to rotate the workpiece 70 and the rotary grindstone 34. The numerical control panel 81 drives the workpiece shaft drive motor 63 and the swing shaft drive motor 45 so that the swing table 31 swings synchronously with the rotation of the workpiece 70 in the thicknesswise direction of the workpiece 70 about a swing axis (center of swing), which is the center of curvature O3 that coincides with the swing axis L5 of the swing shaft 39. That is, the numerical control panel 81 changes the position of the workpiece 70 with respect to the rotary grindstone 34 in synchronization with the rotation of the workpiece 70 so that the workpiece 70, when viewed from the rotary grindstone 34, swings about a reference axis that lies along the center of curvature O3 of the arcuate peripheral surface 70*a*. The reference axis is perpendicular to the axis L3 of the workpiece 70. In the present embodiment, the position of the workpiece 70 with respect to the rotary grindstone 34 is changed by swinging the swing table 31 about the swing axis L5 that coincides with the reference axis. The rotary grindstone 34 is then fed towards the workpiece 70 in the radial direction of the workpiece 70 by driving the grindstone base drive motor 76. In this manner, the rotary grindstone 34 is moved towards or away from the center of curvature O3 of the workpiece 70.

Thus, the teeth grooves 5*b* for forming the hourglass worm 4 is formed on the peripheral surface of the workpiece 70 by swinging the workpiece 70 in a reciprocating manner in the thicknesswise direction of the workpiece 70, that is, about the swing axis L5 with the axis L4 of the rotary grindstone 34 inclined by the lead angle α of the hourglass worm 4 with respect to the axis L3 of the workpiece 70, and by rotating the workpiece 70 about the axis L3 in forward and reverse directions.

Figure 9A:
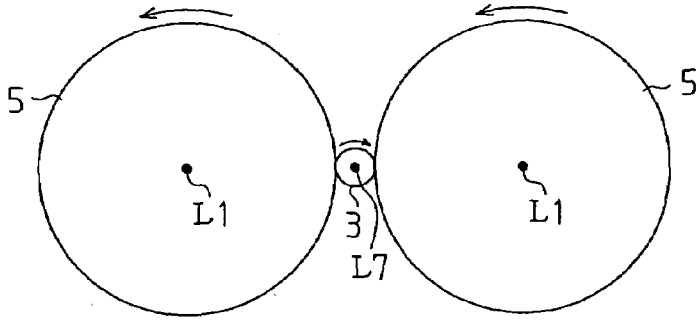
FIG. 9(*a*) is a schematic diagram showing a state in which the hourglass worm is manufactured by a pair of the dies shown in FIG. 4(*a*)
Figure 9B:
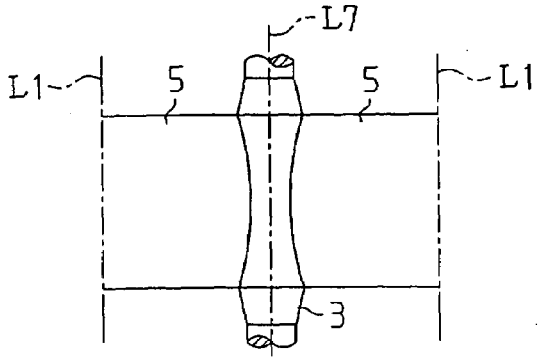

When manufacturing the worm shaft 3 including the hourglass worm 4 with the rolling die 5 manufactured through the above manufacturing method, before the formation of the hourglass worm 4, the worm shaft 3 is arranged between the pair of rolling dies 5, as shown in FIG. 9(*a*). The rolling dies 5 and the worm shaft 3 are positioned so that the axes L1 of the two rolling dies 5 and the axis L7 of the worm shaft 3 are aligned along the same plane. As shown in FIG. 9(*b*), in a state in which the axial movement of the worm shaft 3 is restricted, the worm shaft 3 and the two rolling dies 5 are synchronously and forcibly rotated with the worm shaft 3. The two rolling dies 5 rotate in the same direction. This forms the hourglass worm 4 in the worm shaft 3.

The first embodiment has the advantages described below.

(1) The swinging operation necessary for forming the teeth grooves 5*b*, which form the hourglass worm 4 on the peripheral surface of the workpiece 70, is performed by swinging the workpiece 70. The teeth grooves 5*b*, which form the hourglass worm 4, are formed by feeding the rotary grindstone 34 towards the workpiece 70 in the radial direction of the workpiece 70. Thus, compared to when swinging and moving (feeding) only either the workpiece 70 or the rotary grindstone 34, the occurrence of cumulative error is suppressed. This improves the accuracy of the manufactured hourglass worm rolling die 5, which in turn, improves the accuracy of the hourglass worm 4 manufactured by the rolling die 5.

(2) The manufacturing apparatus 1 is mounted on the table 37 of the multi-purpose screw grinding machine 36. Thus, since the multi-purpose screw grinding machine 36 is employed when using the manufacturing apparatus 1, a completely new device does not need to be manufactured from scratch. This prevents the manufacturing cost of the manufacturing apparatus 1 from being increased.

(3) The manufacturing apparatus 1 includes the slide table 32 that coincides the swing axis L5 of the swing shaft 39 and the swing axis (center of curvature O3) of the workpiece 70. Thus, the swing axis L5 of the swing shaft 39 and the swing axis of the workpiece 70 may be coincided regardless of the size of the workpiece 70 and the curvature of the peripheral surface 70*a*. Therefore, the workpiece 70 may have any size and curvature radius R3 when manufacturing the rolling die 5. Further, the workpiece 70 swings about the center of curvature O3, which is the swing axis, by simply sliding the slide table 32 and coinciding the swing axis L5 of the swing shaft 39 with the center of curvature O3 of the peripheral surface 70*a* of the workpiece 70 in the plane S3.

(4) The workpiece shaft 33 is driven by the workpiece shaft drive motor 63 arranged on the swing table 31. Therefore, the workpiece shaft 33 is rotated by the workpiece shaft drive motor 63 even if connection of the workpiece shaft 33 to a drive mechanism (e.g., spindle) of the multi-purpose screw grinding machine 36 is difficult.

(5) The workpiece shaft drive motor 63, the swing shaft drive motor 45, and the slide table drive motor 54 are connected to a vacant control axis in the numerical control panel 81. Therefore, the workpiece shaft drive motor 63, the swing shaft drive motor 45, and the slide table drive motor 54 are driven without modifying the numerical control panel 81 to operate the manufacturing apparatus 1.

A second embodiment of the present invention will now be described with reference to the drawings. To avoid redundancy, like or same reference numerals are given to those components that are the same or similar in the first embodiment.

Figure 10:
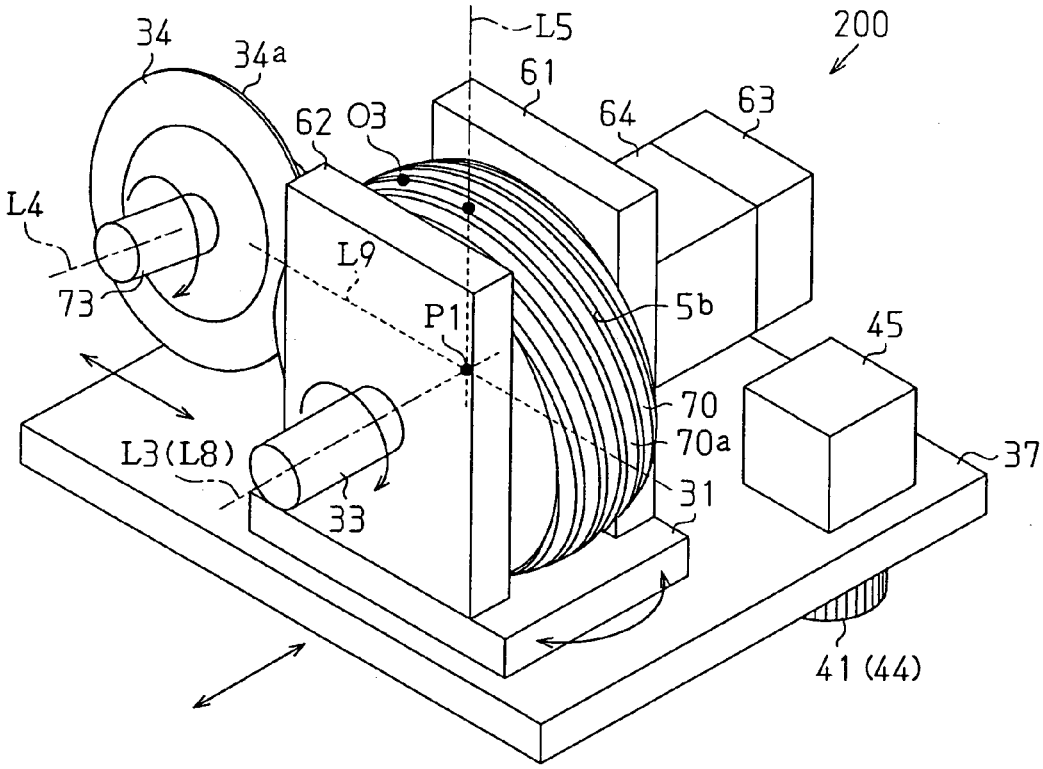
FIG. 10 is a schematic view of a die manufacturing apparatus according to a second embodiment of the present invention.

FIG. 10 shows a manufacturing apparatus 200 of an hourglass worm rolling die. The manufacturing apparatus 200, which is similar to the manufacturing apparatus 1 of the first embodiment, manufactures the rolling die 5, which is used to form the hourglass worm 4 on the worm shaft 3 shown in FIGS. 3(*a*) and 3(*b*).

As shown in FIG. 10, the manufacturing apparatus 200 includes the swing table 31, the workpiece shaft 33, and the rotary grindstone 34. In the second embodiment, the table 37 of the multi-purpose screw grinding machine 36 (refer to FIG. 7) also configures part of the manufacturing apparatus 200. The manufacturing apparatus 200 of the second embodiment differs from the manufacturing apparatus 1 of the first embodiment in that the slide table 32 and the slide mechanism 51 (refer to FIG. 5) are eliminated from the swing table 31.

Figure 12:
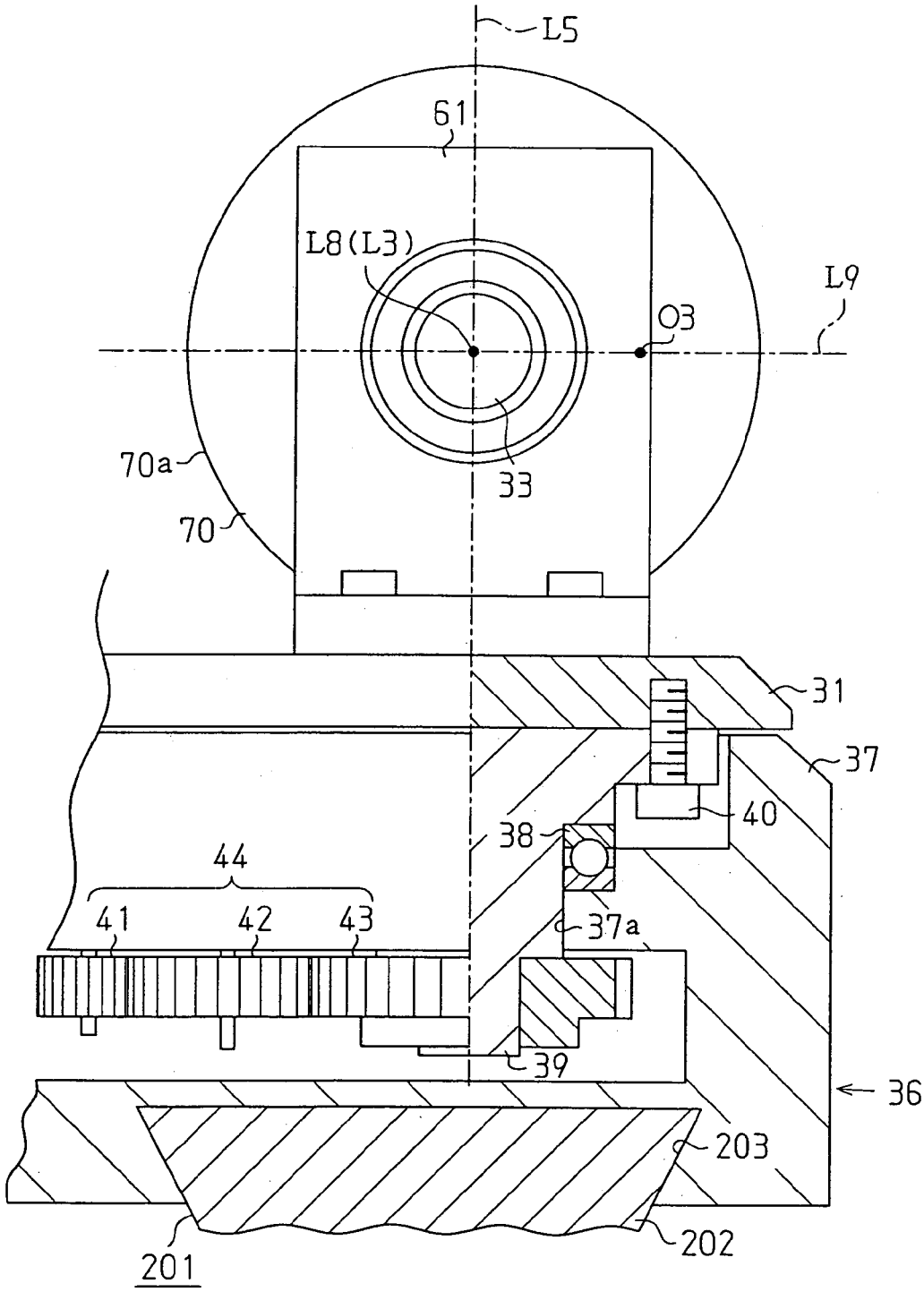
FIG. 12 is a cross-sectional view of the die manufacturing apparatus of FIG. 10.

As shown in FIG. 12, a slide mechanism 201 slides the table 37 in the multi-purpose screw grinding machine 36. The slide mechanism 201 includes a guide rail 202 arranged in a direction orthogonal to the movement direction (feed direction of the rotary grindstone 34) of the grindstone base 72 (refer to FIG. 13). A guide groove 203 that engages with the guide rail 202 is formed on the lower end face of the table 37. A ball screw nut (not shown) forming part of the slide mechanism 201 is attached to the table 37. One end of a screw shaft, which is engaged with the nut, is connected to a table drive motor 83 (refer to FIG. 13). Therefore, when the table drive motor 83 is driven, the screw shaft is rotated in accordance with the driving direction, and the nut is moved in accordance with the rotating direction of the screw shaft. Thus, the table 37 slides with the nut while being guided by the guide rail 202. That is, the drive motor 83 drives and slides the table 37 in the direction orthogonal to the movement direction of the grindstone base 72. The swing table 31 and the reduction gear train 44, which are attached to the table 37, also slide with the table 37.

As shown in FIGS. 10 and 12, in the second embodiment, the support members 61 and 62 are attached to the upper surface of the swing table 31. The support members 61 and 62 face toward each other and are spaced apart by a predetermined distance on the swing table 31. The workpiece shaft 33 is supported by the support members 61 and 62. In the second embodiment, the workpiece shaft 33, which is rotatably supported by the support members 61 and 62, is parallel to the swing table 31, and the axis L8 of the workpiece shaft 33 is orthogonal to the swing axis L5 of the swing shaft 39. The intersection point P1 (refer to FIG. 10)

of the axis L8 of the workpiece shaft 33 and the swing axis L5 of the swing shaft 39 is located in the center between the support members 61 and 62. When the swing table 31 is not swung, the axis L8 of the workpiece shaft 33 is parallel to the slide direction (longitudinal direction of the guide rail 202) of the table 37. When the workpiece 70 is attached to the workpiece shaft 33 supported by the support members 61 and 62, the axis L8 of the workpiece shaft 33 coincides with the axis L3 of the workpiece 70. Further, when the workpiece 70 is attached to the workpiece shaft 33, the swing axis L5 of the swing shaft 39 extends through an intersection point P2 of the axis L3 of the workpiece 70 and a center line L9 extending through the center of the workpiece 70 in the thicknesswise direction. That is, in the present embodiment, the intersection point P1 coincides with the intersection point P2 (refer to FIG. 11). Therefore, when the swing shaft drive motor 45 is driven and swings the swing shaft 39, the workpiece 70 swings about a swing axis defined by the intersection point P2 of the axis L3 of the workpiece 70 and the center line L9.

Figure 13:
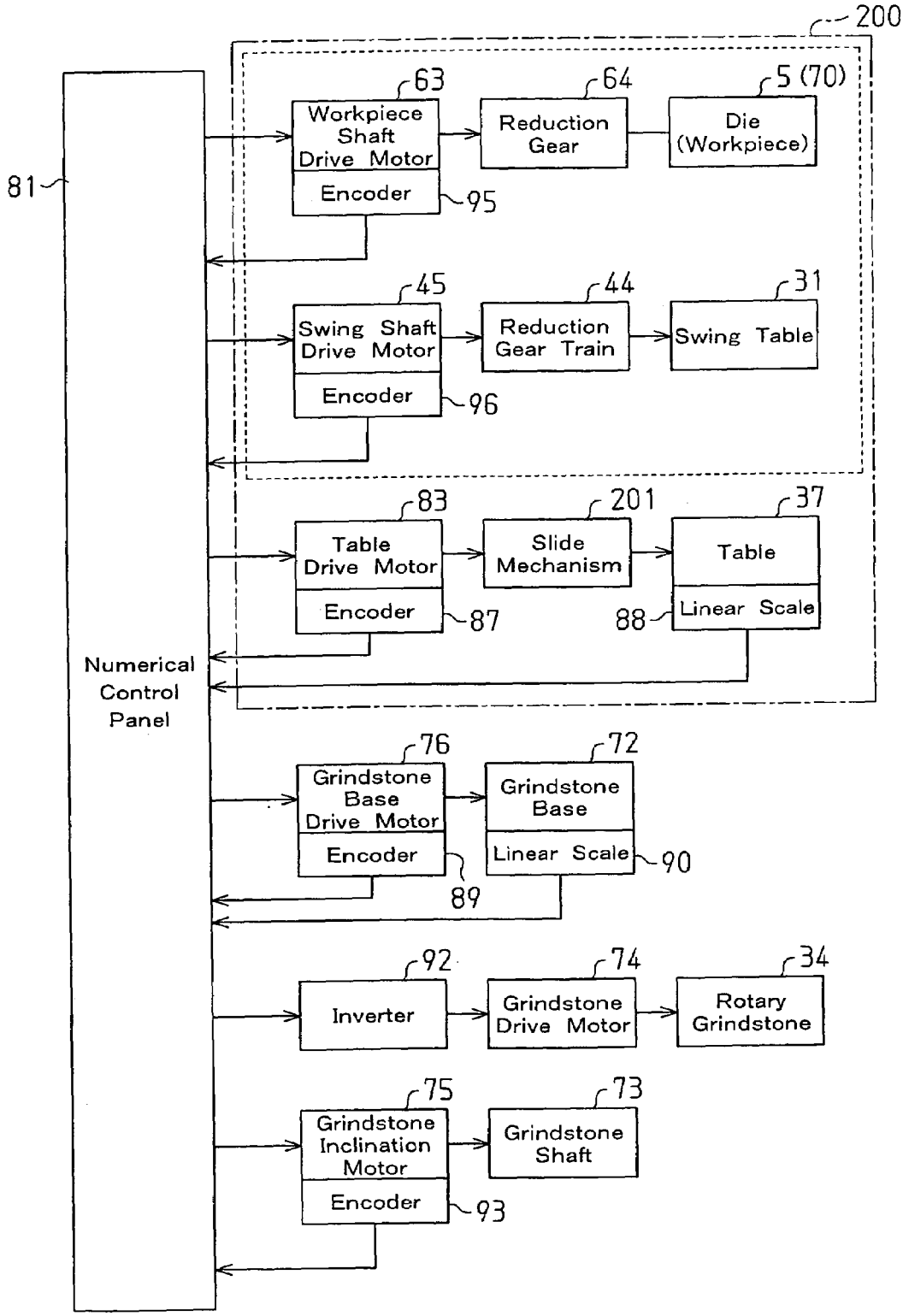
FIG. 13 is a block diagram showing the manufacturing apparatus of FIG. 10 incorporated in a multi-purpose screw grinding machine.

As shown in FIG. 13, the numerical control panel 81 of the second embodiment determines the rotation states of the drive motors 45, 63, 76, 75, and 83 based on the signals corresponding to the rotation states of the drive motors 45, 63, 76, 75, and 83 input from the encoders 87, 89, 93, 95, and 96 and accordingly drives the drive motors 45, 63, 76, 75, and 83, respectively. The numerical control panel 81 also determines the positions of the table 37 and the grindstone base 72 based on the signal input from the linear scales 88 and 90 and accordingly controls the slide amount of the table 37 and the amount the rotary grindstone 91 is fed towards the workpiece 70 based on the detected positions of the table 37 and the grindstone base 72.

The position control of the workpiece 70 and the rotary grindstone 34 executed by the numerical control panel 81 will now be described with reference to FIG. 14 and FIG. 15. The numerical control panel 81 controls the positions of the workpiece 70 and the rotary grindstone 34 in accordance with the rotation amount of the workpiece 70 so that the position of the rotary grindstone 34 relative to the workpiece 70 when the workpiece 70 swings about the intersection point P2 is the same as the position of the rotary grindstone 34 relative to the workpiece 70 when the workpiece 70 swings about the center of curvature O3 of the peripheral surface 70*a* of the workpiece 70.

Figure 11:
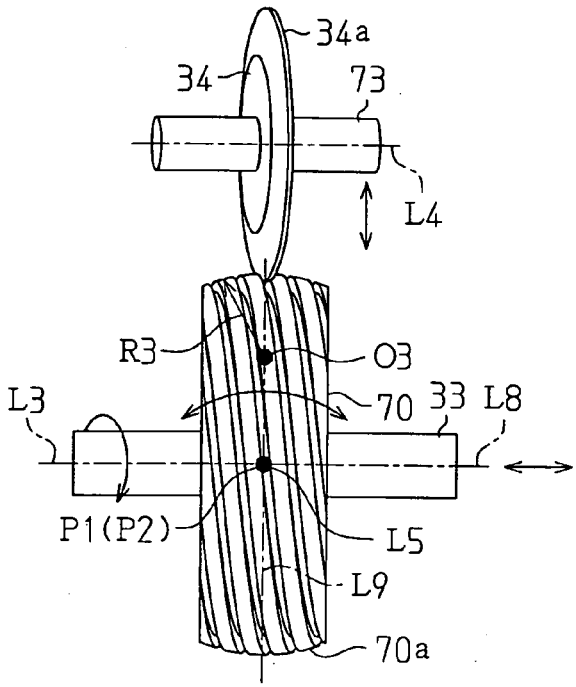
FIG. 11 is a schematic view showing the relationship between the center of curvature of an arc on the peripheral surface of a workpiece and a swing axis of the workpiece in the apparatus of FIG. 10.

The rotation amount (rotation angle) of the workpiece is represented by θ. The workpiece 70 swings (the swing shaft 39 pivots) in synchronization with the rotation of the workpiece 70 (rotation of the workpiece shaft 33) in the same manner as in the first embodiment. Thus, the swing amount (swing angle) of the workpiece 70 is a function of the rotation amount θ of the workpiece 70. The swing amount of the workpiece 70 is expressed as B(θ)[°]. The swing amount B(θ) of the workpiece 70 is an angle obtained by using as a reference (B(θ)=0), the position of the workpiece 70 before it swings, that is, the angle of the workpiece 70 when it is attached to the workpiece shaft 33. The state satisfying B(θ)=0 is a state in which the axis L3 of the workpiece 70 is parallel to the axis L4 of the rotary grindstone 34 when viewing the workpiece 70 and the rotary grindstone 34 from above, as shown in the state of FIG. 11.

Figure 14:
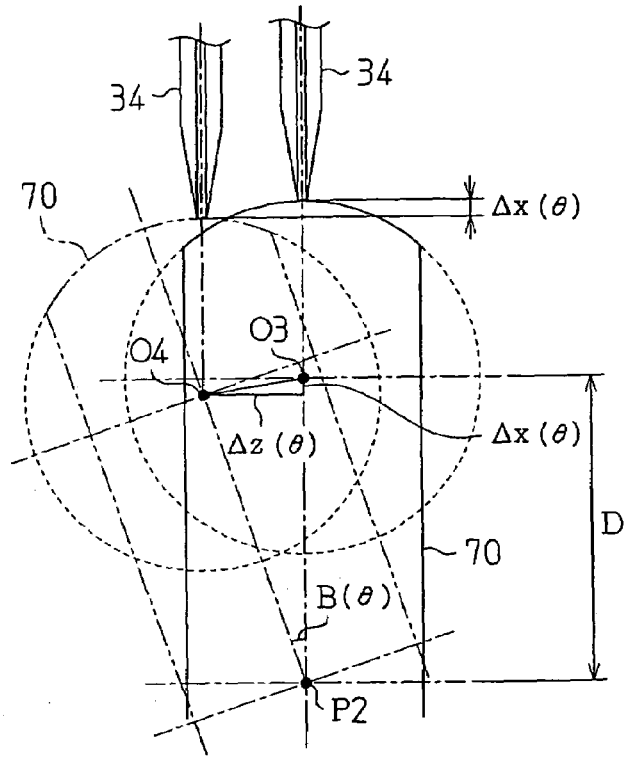
FIG. 14 is an explanatory diagram showing the relative position of a workpiece and a rotary grindstone in a state in which a slide table of the apparatus shown in FIG. 10 is not sliding.
Figure 15:
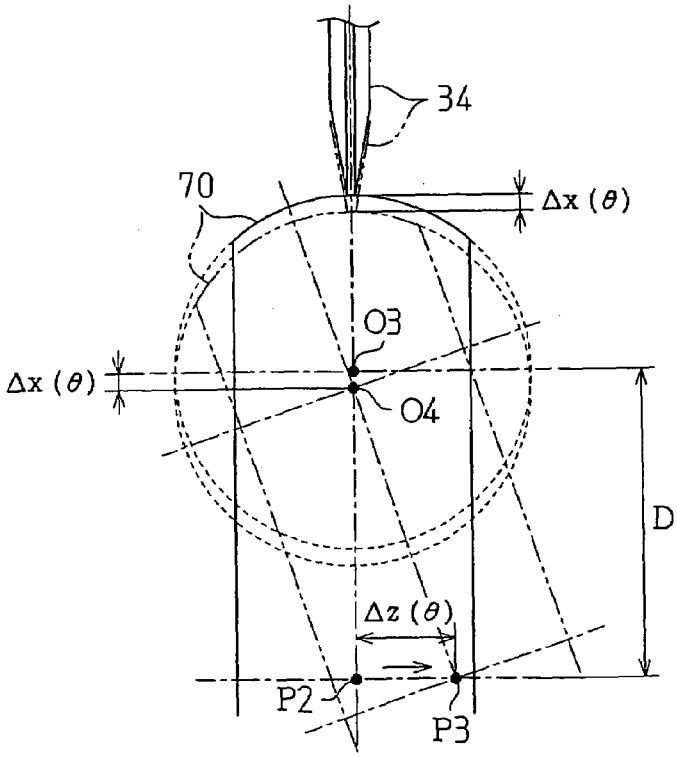
FIG. 15 is an explanatory diagram showing the relative position of the workpiece and the rotary grindstone in a state in which sliding of the slide table of the apparatus shown in FIG. 10 is controlled.

FIG. 14 shows the workpiece 70 in a state attached to the workpiece shaft 33 before swinging (solid line in FIG. 14), and the workpiece 70 in a state swung by B(θ) in the counterclockwise direction about the intersection point P2 (broken line in FIG. 14). As shown in FIG. 14, when the workpiece 70 swings in the counterclockwise direction by B(θ) about the intersection point P2, the position of the rotary grindstone 34 relative to the workpiece 70 is the same as the position of the rotary grindstone 34 relative to the workpiece 70 when it swings about the center of curvature O3. In this state, the rotary grindstone 34 is arranged at a position offset in the clockwise direction by B(θ) with respect to the workpiece 70 about the center of curvature O3. However, movement of the rotary grindstone 34 is disabled in the lateral directions of FIG. 14 (direction orthogonal to the feed direction the rotary grindstone 34) in the present embodiment. Thus, referring to FIG. 15, the workpiece 70 is relatively moved by lateral direction component Δz(θ) (component in the direction orthogonal to the feed direction the rotary grindstone 34) of the movement amount of the center of curvature O4 in FIG. 14 after the swinging with respect to the center of curvature O3 before the swinging. Further, in addition to the feed amount x(θ) of when the workpiece 70 swings about the center of curvature O3, the rotary grindstone 34 is moved by a vertical component Δx(θ) (component along feed direction of the rotary grindstone 34) in FIG. 14 of the movement amount of the center of curvature O4 after the swinging with respect to the center of curvature O3 before the swinging. The vertical direction component Δx(θ) and the lateral direction component Δz(θ) are expressed in the following equation using the swing amount B(θ) and the distance D between the intersection point P2 and the center of curvature O3.

$$\Delta x(\theta)=D\cdot(1-\cos B(\theta)$$

$$\Delta z(\theta)=D\cdot\sin B(\theta)$$

Figure 16A:
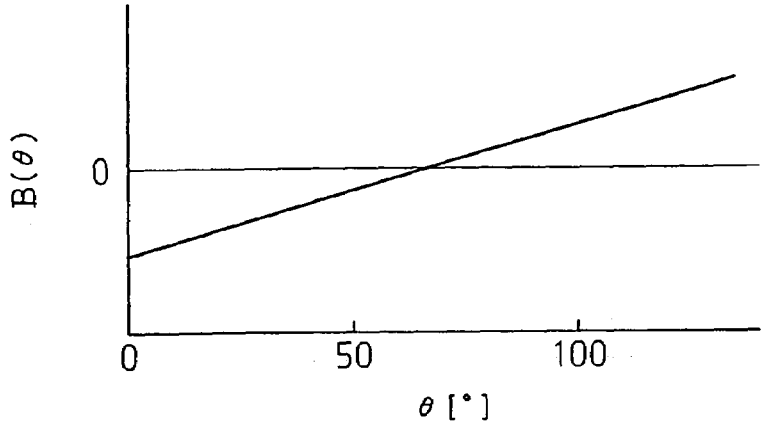
FIG. 16(*a*) is a graph showing the relationship between a rotation amount $\theta$ of the workpiece and a swing amount $B(\theta)$ of the workpiece.
Figure 16B:
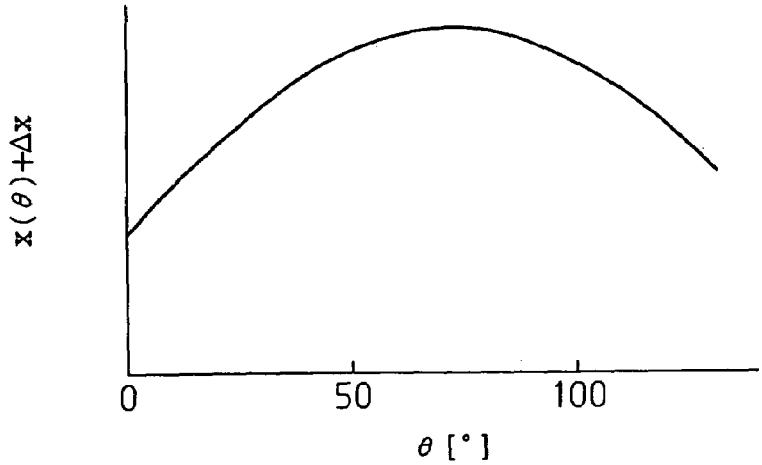
Figure 16C:
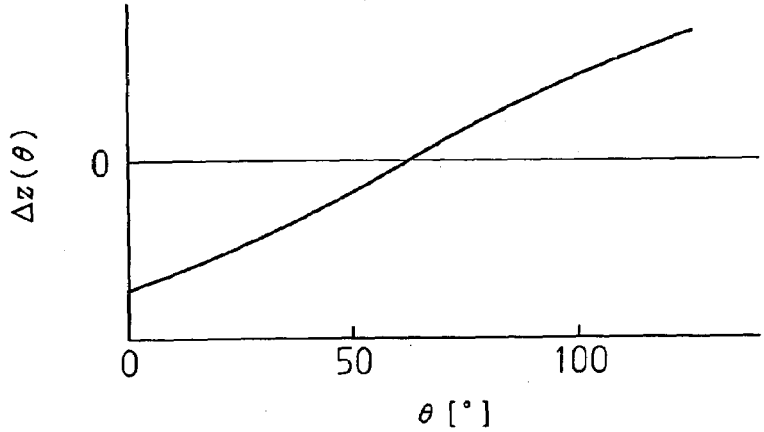

The numerical control panel 81 obtains Δx(θ) and Δz(θ) through the above equations using the swing amount B(θ) of the workpiece 70, feeds the rotary grindstone 34 towards the workpiece 70 by x(θ)+Δx(θ), and slides the workpiece 70 by Δz(θ) in a direction orthogonal to the direction the rotary grindstone 34 is fed in accordance with the swing amount B(θ) of the workpiece 70. The center of curvature O3 is moved by Δx(θ) in the direction the rotary grindstone 34 is fed. The intersection point P2 is moved by Δz(θ) in a direction orthogonal to the direction the rotary grindstone 34 is fed (intersection point P2 after movement is shown as P3 in FIG. 15). FIG. 16(*a*) shows a graph showing the relationship between the rotation amount θ of the workpiece 70 and the swing amount B(θ) of the workpiece 70, FIG. 16(*b*) shows a graph showing the relationship between the rotation amount θ of the workpiece 70 and the feed amount x(θ)+Δx(θ) of the rotary grindstone 34, and FIG. 16(*c*) shows a graph showing the relationship between the rotation amount θ of the workpiece 70 and the slide amount Δz(θ) of the workpiece 70. In FIG. 16(*b*), the vertical axis is −{x(θ)+Δx(θ)} so as to correspond to the movement direction of the rotary grindstone 34, which moves downward in FIG. 14 and FIG. 15.

A method for manufacturing the rolling die 5 with the manufacturing apparatus 200 will now be described.

First, as shown in FIG. 10, the workpiece 70 is attached to the workpiece shaft 33. The swing axis L5 of the swing shaft 39 extends through the intersection point P2 of the axis L3 of the workpiece 70, and the central line L9 extends through the center of the workpiece 70 in the thicknesswise direction (refer to FIG. 11). As shown in FIG. 8(*b*), the numerical control panel 81 drives the grindstone inclination motor 75 to incline the grindstone shaft 73 so that the axis L4 of the rotary grindstone 34 is inclined with respect to the axis lie L3 of the workpiece 70 by the lead angle α of the hourglass worm 4.

Subsequently, the numerical control panel 81 drives the workpiece shaft drive motor 63 and the grindstone drive motor 74 to rotate the workpiece 70 and the rotary grindstone 34. The numerical control panel 81 controls the workpiece shaft drive motor 63 and the swing shaft drive motor 45 so that the swing table 31 is swings in synchronization with the rotation of the workpiece 70. The numerical control panel 81 determines the swing amount B(θ) of the workpiece 70 based on the signal input from the encoder 96 arranged in the swing shaft drive motor 45. The numerical control panel 81 then drives the table drive motor 83 and the grindstone base drive motor 76 in accordance with the detected swing amount B(θ) of the workpiece 70 to move the table 37 by Δz(θ) and to move the grindstone base 72 by x(θ)+Δx(θ). This feeds the rotary grindstone 34 towards the workpiece 70 by x(θ)+Δx(θ) and slides the workpiece 70 by Δz(θ). Therefore, the position of the rotary grindstone 34 relative to the workpiece 70 corresponding to the swing amount of the workpiece 70 swung about the intersection point P2 is the same as the position of the rotary grindstone 34 relative to the workpiece 70 corresponding to the swing amount of the workpiece 70 swung about the center of curvature O3 of the peripheral surface 70*a* of the workpiece 70. That is, the numerical control panel 81 changes the position of the workpiece 70 with respect to the rotary grindstone 34 in synchronization with the rotation of the workpiece 70 so that the workpiece 70, when viewed from the rotary grindstone 34, swings about the reference axis extending through the center of curvature O3 of the circular arc of the peripheral surface 70*a*. The reference axis is perpendicular to the axis L3 of the workpiece 70. In the present embodiment, the swing table 31 supporting the workpiece 70 is swung about the swing axis L5, which is separated from the reference axis. Thus, the numerical control panel 81 controls the movement (i.e., slide) of the swing table 31 and the movement of the rotary grindstone 34 in accordance with the swing of the swing table 31. The movement direction (i.e., sliding direction) of the swing table 31 is orthogonal to the movement direction of the rotary grindstone 34.

In this manner, the teeth grooves 5*b* for forming the hourglass worm 4 is formed on the peripheral surface of the workpiece 70 by swinging the workpiece 70 in a reciprocating manner in the thicknesswise direction about the swing axis L5 while maintaining the axis L4 of the rotary grindstone 34 inclined with respect to the axis L3 of the workpiece 70 by the lead angle α of the hourglass worm 4, and by rotating the workpiece 70 about the axis L8 in the forward and reverse directions.

In addition to advantages (1) and (4) of the first embodiment, the second embodiment has the advantages described below.

(1) The numerical control panel 81 controls the position of the workpiece 70 and the rotary grindstone 34 in accordance with the rotation amount θ of the workpiece 70 so that the position of the rotary grindstone 34 relative to the workpiece 70 swung about the intersection point P2 is the same as the position of the rotary grindstone 34 relative to the workpiece 70 swung about the center of curvature O3 of the peripheral surface 70*a* of the workpiece 70. Therefore, even if the swing shaft 39 is arranged so that its swing axis L5 extends through the intersection point P2 of the axis L3 of the workpiece 70 and the center line L9 extends through the thickness direction of the workpiece 70 and the workpiece 70 is swung about the intersection point P2, the teeth grooves 5*b*, which form the hourglass worm 4, is formed on the peripheral surface 70*a* of the workpiece 70 in the same manner as when the workpiece 70 is swung about the center of curvature O3.

(2) The intersection point P2 of the axis L3 of the workpiece 70 and the center line L9 extending through the center of the workpiece 70 in the thicknesswise direction is the center point of the workpiece 70. Since the swing axis L5 of the swing shaft 39 extends through the center point of the workpiece 70, the workpiece 70 swings more stably. This improves the accuracy of the rolling die 5 manufactured by the manufacturing apparatus 200.

(3) In the manufacturing apparatus 200, the axis L8 of the workpiece shaft 33 and the swing axis L5 of the swing shaft 39 are orthogonal to each other. Thus, when the workpiece 70 is attached to the workpiece shaft 33, the swing axis L5 of the swing shaft 39 extends through the intersection point P2 of the axis L3 of the workpiece 70, and the center line L9 extends through the center of the workpiece 70 in the thicknesswise direction. Therefore, unlike the manufacturing apparatus 1 of the first embodiment, the swing axis L5 of the swing shaft 39 does not need to coincide with the center of curvature O3 of the peripheral surface 70*a* of the workpiece 70 in the plane S3 that extends through the axis L3 of the workpiece 70 and that is parallel to the swing table 31 when sliding the slide table 32. As a result, the manufacturing time for the rolling die 5 is shortened.

As long as the workpiece 70 has a diameter supportable by the workpiece shaft 33 and is attached to the workpiece shaft 33, the swing axis L5 of the swing shaft 39 extends through the intersection point P2 (intersection point of the axis L3 of the workpiece 70 and the center line L9 passing through the center in the thickness direction of the workpiece 70). Therefore, the teeth grooves 5*b*, which form the hourglass worm 4, is formed on the peripheral surface 70*a* of the workpiece 70 having any size or any curvature as long as the workpiece 70 is within a range supportable by the workpiece shaft 33.

Further, in the manufacturing apparatus 200, the manufacturing apparatus 200 is easily assembled if the axis L8 of the workpiece shaft 33 and the swing axis L5 of the swing shaft 39 are orthogonal to each other.

(4) The manufacturing apparatus 200 of the second embodiment has a structure in which the slide table 32 in the manufacturing apparatus 1 of the first embodiment is eliminated. Therefore, the manufacturing apparatus 200 may be more compact compared to the manufacturing apparatus 1 of the first embodiment. Further, when the manufacturing apparatus 200 has the same size as the manufacturing apparatus 1, a larger rolling die 5 may be manufactured due to the elimination of the slide table 32. Since the slide table 32 is eliminated, the manufacturing apparatus 200 has a simpler structure than the manufacturing apparatus 1 of the first embodiment and maintenance work is easier to perform than the manufacturing apparatus 1.

(5) The workpiece shaft drive motor 63 and the swing shaft drive motor 45 are connected to the available control shaft existing in the numerical control panel 81. Therefore, the workpiece shaft drive motor 63, the swing shaft drive motor 45, and the slide table drive motor 54 are driven without modifying the numerical control panel 81 to operate the manufacturing apparatus 1.

(6) The numerical control panel 81 determines the positions of the grindstone base 72 and the table 37, which are moved when processing the workpiece 70, based on the signals input from the linear scale 88 and the linear scale 90 and accordingly controls the table drive motor 83 and the grindstone base drive motor 76. Therefore, in addition to the signals from the encoders 87 and 89 representing the rotation state of the table drive motor 83 and the grindstone base drive motor 76, the linear scales 88 and 90 directly detecting the positions of the moved table 37 and grindstone base 72 are used so that the numerical control panel 81 executes the position control of the table 37 and the grindstone base 72 with further accuracy. As a result, the accuracy of the rolling die 5 manufactured in the manufacturing apparatus 200 is further improved.

(7) When swinging the workpiece 70 about the intersection point P2, the swing angle of the workpiece 70 necessary for processing the workpiece 70 is smaller compared to when swinging the workpiece 70 about the center of curvature O3 of the peripheral surface 70*a*. Therefore, the manufacturing time of the rolling die 5 is shortened.

It should be apparent to those skilled in the art that the present invention may be embodied in many other specific forms without departing from the spirit or scope of the invention. Particularly, it should be understood that the present invention may be embodied in the following forms.

In the first and the second embodiments, the workpiece shaft 33 is rotated by the workpiece shaft drive motor 63, which is arranged on the swing table 31. However, the present invention is not limited to such arrangement. For example, as shown by the broken line in FIG. 7, the spindle and the workpiece shaft 33 of the multi-purpose screw grinding machine 36 may be coupled by a coupling 100, which functions as a joint such as a universal joint. In such structure, a separate workpiece shaft drive motor 63 for rotating the workpiece shaft 33 is not necessary. Consequently, the hourglass worm rolling die 5 is manufactured by the manufacturing apparatus 1 having a simpler structure.

In the first and the second embodiments, the manufacturing apparatus 1, 200 is attached to the table 37 of the multi-purpose screw grinding machine 36. However, the present invention is not limited to such arrangement. For example, an exclusive device for operating the manufacturing apparatus 1 may be employed.

In the first and the second embodiments, the numerical control panel 81 is used as a synchronization mechanism for synchronizing the rotation of the workpiece shaft 33 and the swinging of the swing shaft 39. However, the present invention is not limited to such arrangement. For example, gears may be combined to synchronize the rotation of the workpiece shaft 33 and the swinging of the swing shaft 39.

In the first and the second embodiments, the inverter 92 controls the rotation speed of the rotary grindstone 34 or 91 with the grindstone drive motor 74. However, the present invention is not limited to such arrangement. For example, the grindstone drive motor 74 may be a motor including an encoder like the grindstone base drive motor 76. In this case, the numerical control panel 81 controls the grindstone drive motor 74 based on a signal corresponding to the rotation state of the grindstone drive motor 74 output from the encoder.

In the second embodiment, the workpiece 70 swings about the intersection point P2 of the axis L3 of the workpiece 70 and the center line L9 extending through the center in the thicknesswise direction of the workpiece 70. However, the present invention is not limited to such arrangement. The workpiece 70 may swing about a position separated from the center of curvature O3 of the peripheral surface 70*a* of the workpiece 70. That is, the swing shaft 39 may be arranged so that the swing axis L5 of the swing shaft 39 is separated from the center of curvature O3 of the peripheral surface 70*a* of the workpiece 70. In this case, the numerical control panel 81 also controls the positions of the workpiece 70 and the rotary grindstone 34 in accordance with the rotation amount θ of the workpiece 70 so that the position of the rotary grindstone 34 relative to the workpiece 70 swung about the position separated from the center of curvature O3 is the same as the position of the rotary grindstone 34 relative to the workpiece 70 swung about the center of curvature O3. When configured in this manner, the degree of freedom of the arrangement position of the swing shaft 39 increases. When the swing shaft 39 is arranged so that the center line L9, which extends through the center in the thicknesswise direction of the workpiece 70, and the swing axis L5 of the swing shaft 39 are orthogonal to each other, the position control of the table 37 and the rotary grindstone 34 performed by the numerical control panel 81 is facilitated. Further, the numerical control panel 81 calculates and controls the position of the workpiece 70 and the feed amount of the rotary grindstone 34 so that the position of the workpiece 70 relative to the rotary grindstone 34 is the same as when swinging the workpiece 70 about the center of curvature O3 of the peripheral surface 70*a* of the workpiece 70. Thus, by simply changing the contents of the calculation performed in the numerical control panel 81, the rolling die including a cutaway part on the worm shaft 3 for forming may be manufactured without modifying the entire manufacturing apparatus 200.

In each embodiment, the workpiece 70 has an arcuate peripheral surface 70*a* that projects with the same curvature as the root surface of the hourglass worm 4. However, the shape of the workpiece 70 is not limited in such manner. As long as the workpiece 70 is disk-shaped, the workpiece 70 may be, for example, cylindrical. In this case, the swing axis of the workpiece 70 is set based on the center of curvature of the peripheral surface 5*a* of the rolling die 5 formed by processing the workpiece 70.

It should be apparent to those skilled in the art that the present invention may be embodied in many other specific forms without departing from the spirit or scope of the invention. Therefore, the present invention is not to be limited to the details given herein, but may be modified within the scope and equivalence of the appended claims.

What is claimed is:

1. A method for manufacturing a die for rolling an hourglass worm, the hourglass worm including a curved root surface with a cross-section extending along an axis of the hourglass worm that defines an arc, the method comprising the steps of:

rotating a disk-shaped workpiece about an axis of the workpiece, the workpiece including a peripheral surface with a cross-section extending along the axis of the workpiece that defines an arc corresponding to the arc of the root surface of the hourglass worm;

rotating a rotary grindstone about an axis of the rotary grindstone;

inclining the axis of the rotary grindstone relative to the axis of the workpiece by a lead angle of the hourglass worm;

moving the workpiece relative to the rotary grindstone so that the workpiece, when viewed from the rotary grindstone, swings about a reference axis substantially perpendicular to the axis of the workpiece and extends substantially through a center of curvature of the arc defined on the peripheral surface of the workpiece; and forming teeth grooves, for rolling the hourglass worm, on the peripheral surface of the workpiece by rotating and pressing the rotary grindstone against the peripheral surface of the workpiece while moving the workpiece with respect to the rotary grindstone in synchronism with the rotation of the workpiece.

2. The method according to claim 1, wherein the step of moving the workpiece relative to the rotary grindstone includes swinging a swing table that supports the workpiece about a swing axis coinciding with the reference axis.

3. The method according to claim 1, wherein the step of moving the workpiece relative to the rotary grindstone includes:

swinging a swing table that supports the workpiece about a swing axis separated from the reference axis;

moving the swing table along a plane extending substantially perpendicular to the swing axis;

moving the rotary grindstone towards or away from the workpiece; and controlling the movement of the swing table and the movement of the rotary grindstone in accordance with the swinging of the swing table.

4. The method according to claim 3, wherein the swing table moves in a direction substantially perpendicular to a direction in which the rotary grindstone moves.

5. The method according to claim 3, wherein the rotary grindstone moves towards or away from the center of curvature of the arc defined on the peripheral surface of the workpiece.

6. The method according to claim 3, wherein the swing axis of the swing table extends through a center point in a thicknesswise direction of the workpiece located on the axis of the workpiece.

7. The method according to claim 1, further comprising the steps of:

preparing a multi-purpose screw grinding machine including a swing table and a movement table mounted on the swing table;

supporting the workpiece with a workpiece shaft arranged on the movement table;

moving the movement table relative to the swing table so as to coincide a swing axis of the swing table with the reference axis;

swinging the swing table to swing the workpiece; and rotating the workpiece shaft to rotate the workpiece.

8. The method according to claim 7, further comprising the step of:

rotating the workpiece with a motor arranged on the swing table.

9. The method according to claim 7, further comprising the step of:

coupling a spindle of the multi-purpose screw grinding machine to the workpiece shaft with a coupling.

10. The method according to claim 3, further comprising the steps of:

preparing a multi-purpose screw grinding machine including the swing table;

supporting the workpiece with a workpiece shaft arranged on the swing table;

rotating the workpiece shaft to rotate the workpiece;

swinging the swing table in synchronization with the rotation of the workpiece shaft; and moving the swing table relative to the rotary grindstone in accordance with the swinging of the swing table.

11. An apparatus for manufacturing a die for rolling an hourglass worm, the hourglass worm including a curved root surface with a cross-section extending along an axis of the hourglass worm that defines an arc, the apparatus comprising:

a swing table swingable about a swing axis;

a movement table movably mounted on the swing table;

a workpiece shaft arranged on the movement table, the workpiece shaft rotating a disk-shaped workpiece about an axis of the workpiece, the axis of the workpiece being substantially perpendicular to a swing axis of the swing table, the workpiece including a peripheral surface with a cross-section extending along the axis of the workpiece that defines an arc substantially identical to the arc of the root surface of the hourglass worm, the movement table being arranged so that the swing axis of the swing table extends substantially through a center of curvature of the arc defined on the peripheral surface of the workpiece;

a rotary grindstone for forming teeth grooves, for rolling the hourglass worm, on the peripheral surface of the workpiece, an axis of the rotary grindstone being inclined relative to the axis of the workpiece by a lead angle of the hourglass worm, the rotary grindstone being movable towards or away from the center of curvature of the arc defined on the peripheral surface of the workpiece; and a synchronization mechanism for swinging the swing table in synchronism with the rotation of the workpiece shaft.

12. The apparatus according to claim 11, further comprising:

a motor arranged on the swing table to rotate the workpiece shaft.

13. The apparatus according to claim 11, wherein the apparatus is incorporated in a multi-purpose screw grinding machine including a spindle, the apparatus further comprising:

a coupling for connecting the spindle to the workpiece shaft.

14. An apparatus for manufacturing a die for rolling an hourglass worm, the hourglass worm including a curved root surface with a cross-section extending along an axis of the hourglass worm that defines an arc, the apparatus comprising:

a rotary grindstone for forming teeth grooves, for rolling the hourglass worm, on the peripheral surface of a disk-shaped workpiece, the peripheral surface of the workpiece including a cross-section extending along an axis of the workpiece that defines an arc substantially identical to the arc of the root surface of the hourglass worm;

a movable movement table moved relative to the rotary grindstone;

a swing table arranged on the movement table;

a workpiece shaft arranged on the swing table, the workpiece shaft rotating the workpiece about the axis of the workpiece, an axis of the rotary grindstone being inclined relative to the axis of the workpiece by a lead angle of the hourglass worm, the rotary grindstone being movable towards or away from a center of curvature of the arc defined on the peripheral surface of the workpiece;

a synchronization mechanism for swinging the swing table in synchronism with the rotation of the workpiece shaft; and a controller for controlling the movement of the movement table and the movement of the rotary grindstone in accordance with the swinging of the swing table so that the workpiece, when viewed from the rotary grindstone, swings about a reference axis that extends substantially through the center of curvature of the arc defined on the peripheral surface of the workpiece, wherein the reference axis is substantially perpendicular to the axis of the workpiece and separated from the swing axis.

15. The apparatus according to claim 14, wherein the axis of the workpiece is substantially perpendicular to the swing axis of the swing table.

16. The apparatus according to claim 14, wherein the movement table is moved in a direction substantially perpendicular to a direction in which the rotary grindstone moves.

17. An apparatus for manufacturing a die for rolling an hourglass worm, the hourglass worm including a curved root surface with a cross-section extending along an axis of the hourglass worm that defines an arc, the apparatus comprising:

a means for rotating a disk-shaped workpiece about an axis of the workpiece, the workpiece including a peripheral surface with a cross-section extending along an axis of the workpiece that defines an arc substantially identical to the arc of the root surface of the hourglass worm;

a means for rotating a rotary grindstone about an axis of the rotary grindstone, the axis of the rotary grindstone being inclined relative to the axis of the workpiece by a lead angle of the hourglass worm; and a means for moving the workpiece relative to the rotary grindstone so that the workpiece, when viewed from the rotary grindstone, swings about a reference axis that is substantially perpendicular to the axis of the workpiece and extends through a center of curvature of the arc defined on the peripheral surface of the workpiece; and a means for forming teeth grooves, for rolling the hourglass worm, on the peripheral surface of the workpiece by rotating and pressing the rotary grindstone against the peripheral surface of the workpiece while moving the workpiece with respect to the rotary grindstone in synchronism with the rotation of the workpiece.

18. A method for manufacturing a die for rolling an hourglass worm, the hourglass worm including a curved root surface with a cross-section extending along an axis of the hourglass worm that defines an arc, the die including a peripheral surface with a cross-section extending along the axis of the die that defines an arc corresponding to the arc of the root surface of the hourglass worm, the method comprising the steps of:

rotating a disk-shaped workpiece about an axis of the workpiece;

rotating a rotary grindstone about an axis of the rotary grindstone;

inclining the axis of the rotary grindstone relative to the axis of the workpiece by a lead angle of the hourglass worm;

moving the workpiece relative to the rotary grindstone so that the workpiece, when viewed from the rotary grindstone, swings about a reference axis substantially perpendicular to the axis of the workpiece and extends substantially through a center of curvature of the arc defined on the peripheral surface of the die; and forming teeth grooves, for rolling the hourglass worm, on the peripheral surface of the workpiece by rotating and pressing the rotary grindstone against the peripheral surface of the workpiece while moving the workpiece with respect to the rotary grindstone in synchronism with the rotation of the workpiece.

* * * * *